US005240391A

United States Patent [19]

Ramshankar et al.

[11] Patent Number: 5,240,391

[45] Date of Patent: Aug. 31, 1993

[54] COMPRESSOR SUCTION INLET DUCT

[75] Inventors: Rengasamy Ramshankar; Rudy S. Chou, both of Liverpool, N.Y.

[73] Assignee: Carrier Corporation, Syracuse, N.Y.

[21] Appl. No.: 886,576

[22] Filed: May 21, 1992

[51] Int. Cl.[5] ..... F04B 17/00; F01C 1/02

[52] U.S. Cl. ..... 417/410 R; 417/366; 417/372; 418/55.6; 418/DIG. 1

[58] Field of Search ..... 417/410, 366, 372, 902; 418/55.6, DIG. 1

[56] References Cited

U.S. PATENT DOCUMENTS 4,767,293 8/1988 Caillat et al. ..... 418/55
4,877,382 10/1989 Caillat et al. ..... 418/55
4,886,435 12/1989 Sawai et al. ..... 418/DIG. 1
4,895,496 1/1990 Elson ..... 417/372
4,992,033 2/1991 Caillat et al. ..... 418/55.3
4,998,864 3/1991 Muir ..... 417/410
5,055,010 10/1991 Logan ..... 417/410
5,064,356 11/1991 Horn ..... 417/410
5,114,322 5/1992 Caillat et al. ..... 418/55.6

*Primary Examiner*—Richard A. Bertsch
*Assistant Examiner*—Alfred Basichas

[57] ABSTRACT

Suction gas is used to cool the motor of a low-side hermetic compressor. The suction flow is divided. A small amount of the suction flow, e.g. 15%, is diverted to cool the motor and is recombined, via aspiration, with the main flow which is supplied directly to the inlet of the running gear of the compressor.

9 Claims, 3 Drawing Sheets

COMPRESSOR SUCTION INLET DUCT

BACKGROUND OF THE INVENTION

In low side hermetic compressors all or most of the shell is filled with gas at suction pressure. The suction gas returns to the compressor at a relatively low temperature and it is commonly used to cool the motor. Cooling the motor with the suction gas warms the suction gas and reduces its density, thereby resulting in less mass being compressed for the same compressor displacement.

U.S. Pat. No. 5,055,010 is directed to a suction baffle for a low side hermetic scroll compressor. The suction baffle is secured to the shell and includes a "generously sized dome" which is "substantially centered vertically and circumferentially on (the) inlet port". Suction gas entering the compressor will tend to impinge upon the suction baffle such that entrained oil and liquid refrigerant will tend to collect on the surface and drain downwardly. Suction gas entering the compressor is divided into two flow paths. The first path is downward and is also the path of the separated liquids. Flow from the first path will then flow over and cool the motor. The second path is axially upward along a much longer, confined flow path opening into the interior of the shell. The reference is silent as to the division of the flows by percentage and as to their exact paths and recombination. With the symmetrically located dome facing the inlet, it is equally likely to divert the flow downwardly as upwardly. With a relatively very short path into the shell in the region of the motor, it is likely that at least half of the flow will be diverted downwardly and will flow over and cool the motor.

Because motors are designed to run at an elevated temperature, it is only necessary to cool them to their desired operating temperature. Any benefits to the motor from additional cooling of the motor are outweighed by losses in efficiency due to the heating of the suction gas.

SUMMARY OF THE INVENTION

Suction flow into the shell of a hermetic scroll compressor impinges upon and is divided into two flows by a suction inlet duct. The majority of the flow is directed directly to the inlet of the scroll wraps via a confined flow path. A small percentage, normally less than 25%, of the flow is directed into the interior of the shell for cooling the motor. Since the interior of the shell is nominally at the same pressure as the suction inlet duct and the inlet to the scrolls, it is necessary to provide a circulation mechanism for the cooling flow. The suction produced at the inlet of the scroll wraps is the mechanism for drawing gas into the shell of the compressor but this does not per se produce the desired cooling flow. According to the teachings of the present invention, the suction inlet duct leads directly to the inlet of the scroll wraps so there is a lower pressure in the suction inlet duct than in the interior of the shell. The only reason that gas goes into the shell rather than through the suction inlet duct is due to its being diverted by impingement. Because the inlet of the scrolls is creating a reduced pressure in the suction inlet duct, the suction inlet duct is provided with an aspiration inlet. Specifically, the suction inlet duct is provided with a 90° bend and the aspiration inlet is located in the region of the inner turn of the 90° bend. Since the aspiration inlet is at a lower pressure than that in the shell, gas in the shell is drawn over the motor and into the suction inlet duct via the aspiration inlet thereby providing a cooling flow over the motor. A second aspiration inlet can be provided in the region of the outer turn. The second aspiration inlet location is such that it would tend to draw gas across and cool the upper scroll.

It is an object of this invention to minimize the pressure drop in the suction line duct.

It is another object of this invention to divide the entering flow into a primary stream that enters the scrolls directly and a secondary flow which passes over and cools the motor.

It is a further object of this invention to rejoin the divided entering flow streams in such a way that there is no additional penalty in terms of pressure loss. These objects, and others as will become apparent hereinafter, are accomplished by the present invention.

Basically a small portion of the inlet flow of a hermetic compressor is diverted into the interior of the shell while the remainder of the flow is directed directly to the scrolls. The diverted flow is aspirated into the remainder of the flow and is thereby caused to flow over and cool the motor.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
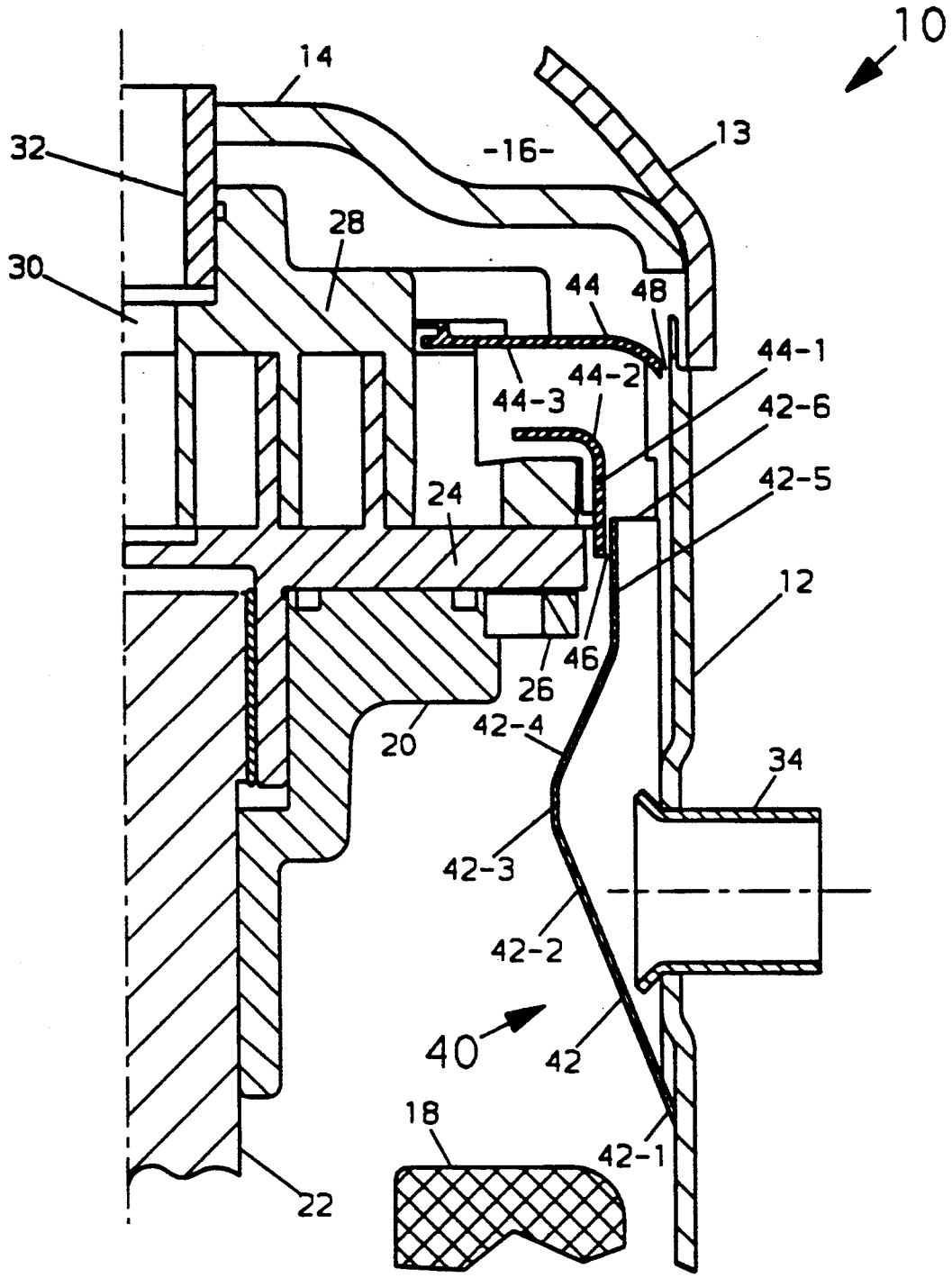
FIG. 1 is a partial sectional view of a vertical, low side hermetic scroll compressor employing the suction inlet duct of the present invention.
Figure 2:
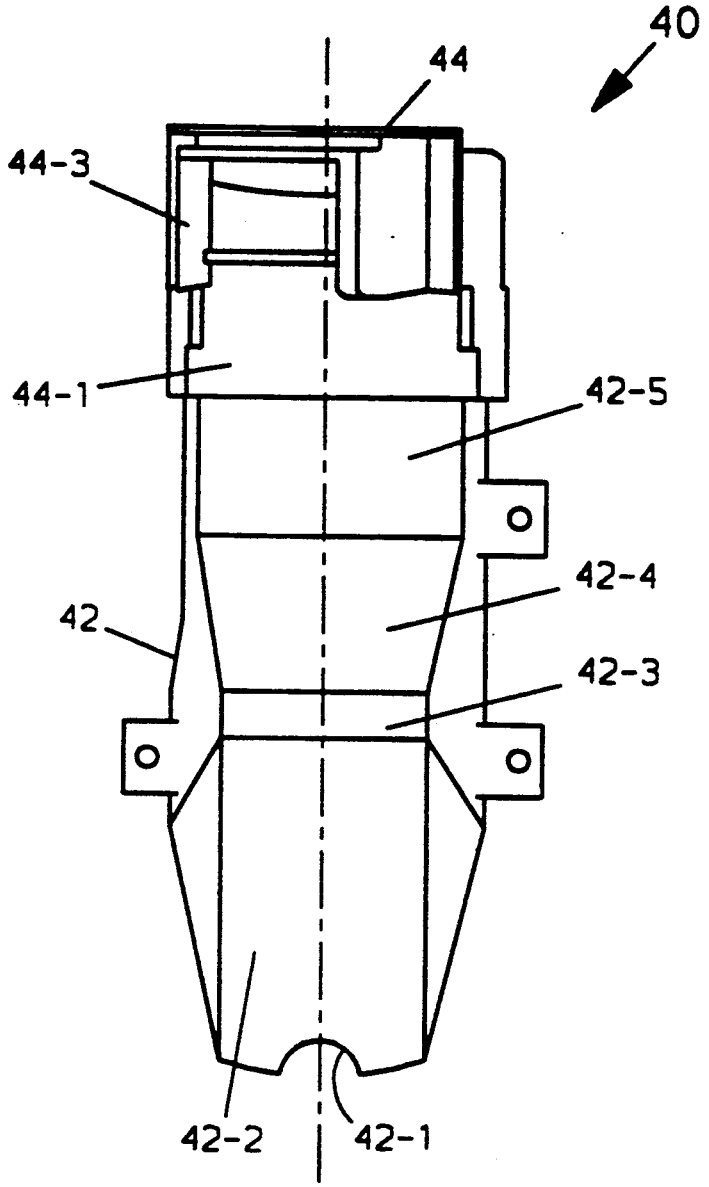
FIG. 2 is a view of the suction inlet duct of FIG. 1 as viewed from the interior of the compressor.

In FIG. 1, the numeral 10 generally designates a vertical, low side, hermetic scroll compressor. Compressor 10 includes a shell 12 having a cover 13. Divider plate 14 coacts with cover 13 to define discharge chamber 16 and to isolate discharge chamber 16 from the interior of shell 12 which is at suction pressure. Crankcase 20 is welded or otherwise suitably secured to shell 12. Crankshaft 22 drives orbiting scroll 24 which is held to an orbiting motion by Oldham coupling 26. Orbiting scroll 24 coacts with fixed scroll 28 to draw gas into the compressor 10, to compress the gas and to discharge the compressed gas via discharge port 30, and discharge tube 32 into discharge chamber 16 from which the compressed gas passes via the discharge outlet (not illustrated) to the refrigeration system. Gas is returned from the refrigeration system and supplied to the compressor 10 via suction inlet 34. The compressor structure described so far is generally conventional. The present invention adds suction inlet duct structure to the compressor structure. Specifically, suction inlet duct 40 is made up of two members, metal retainer 42 and plastic duct 44. Retainer 42 is fixed to the interior of shell 12. Retainer 42 coacts with the interior of shell 12 to define two flow paths or, more accurately, a flow path with two outlets. Lower outlet 42-1 is the most restricted portion of the flow path defined by retainer 42 and outlet 42-1 discharges into the interior of the shell 12 so as to provide a cooling flow to the illustrated windings of motor 18. Diverging portion 42-2 of retainer 42 extends from outlet 42-1 to a point above suction inlet 34 such that suction inlet 34 faces a diverging surface, defined by portion 42-2, which diverges upwardly to an axial portion 42-3 defining a uniform cross sectional area. Axial portion 42-3 transitions into converging portion 42-4 which, in turn, transitions into axial portion 42-5 having outlet 42-6. Outlet 42-6 discharges into vertical leg 44-1 of duct 44. There is a space between the vertical leg 44-1 and axial portion 42-5 that defines aspiration inlet 46. Horizontal leg 44-3 is connected to vertical leg 44-1 via curved portion 44-2 and discharges directly into the inlet of scrolls 24 and 28. As is best shown in FIG. 2, horizontal leg 44-3 extends in a generally tangential direction since the inlets of the scrolls 24 and 28 are at the outer peripheries of their wraps. It will be noted that a second aspiration inlet 48 is formed in the outer curved portion of portion 44-2.

In operation, motor 18 drives crankshaft 22 which causes orbiting scroll 24 to move, but with movement of the orbiting scroll 24 being held to an orbiting motion by Oldham coupling 26, as is conventional. Orbiting scroll 24 in its orbiting motion coacts with fixed scroll 28 to trap volumes of gas which are compressed and exhausted through discharge port 30 and discharge tube 32 into discharge chamber 16 which is in fluid communication with a refrigeration system (not illustrated). In trapping volumes of gas, the scrolls 24 and 28 create a partial vacuum which draws gas into compressor 10. Specifically, there is a generally confined fluid path serially including suction inlet 34, metal retainer 42, and duct 44 which connects directly with the inlets of scrolls 24 and 28 which define the suction source. Gas entering compressor 10 via suction inlet 34 impinges upon the surface of metal retainer 42 which, relative to the axis of suction inlet 34, is diverging in an upward direction and converging in a downward direction. The partial vacuum at the scrolls and the diverging upward path towards the scrolls favors the flow of gas upwardly to the scrolls. However, impingement tends to produce an omnidirectional, but unevenly distributed flow. As a result a small amount, such as 15%, of the flow will be diverted downwardly for the short distance to outlet 42-1 and will flow into the interior of shell 12 and over motor 18. It is not essential to have a uniform flow since localized cooling of motor 18 by convection will produce cooling in other area due to conduction.

The major portion of the flow moves upwardly serially through the diverging area corresponding to portion 42-2, a constant area corresponding to portion 42-3, a converging area corresponding to portion 42-4, and a constant area corresponding to portion 42-5. Outlet 42-6 of portion 42-5 discharges within vertical leg 44-1 of duct 44. A clearance between portion 42-5 and leg 44-1 defines aspiration inlet 46 which draws in gas supplied to the interior of shell 12 via outlet 42-1 thereby recombining the motor cooling flow with the main flow. Flow through leg 44-1 passes through curved portion 44-2 and leg 44-3 into the scrolls. An aspiration inlet 48 may be located in the curved portion 44-2 if necessary, or desired. The location of aspiration inlet 48 relative to that of aspiration inlet 46 is such that aspiration inlet 48 will tend to draw in gas which has passed over fixed scroll 28 in addition to the motor 18, since the source of the gas flow to both aspiration inlets is the outlet 42-1. Thus, aspiration inlet 48 can be used to achieve cooling of additional members as well as providing for additional gas flow which may be beyond the desired operation of aspiration inlet 46. To achieve a proper aspiration flow it is best to have the cross sectional areas of legs 44-1 and 44-3 identical.

Figure 3:
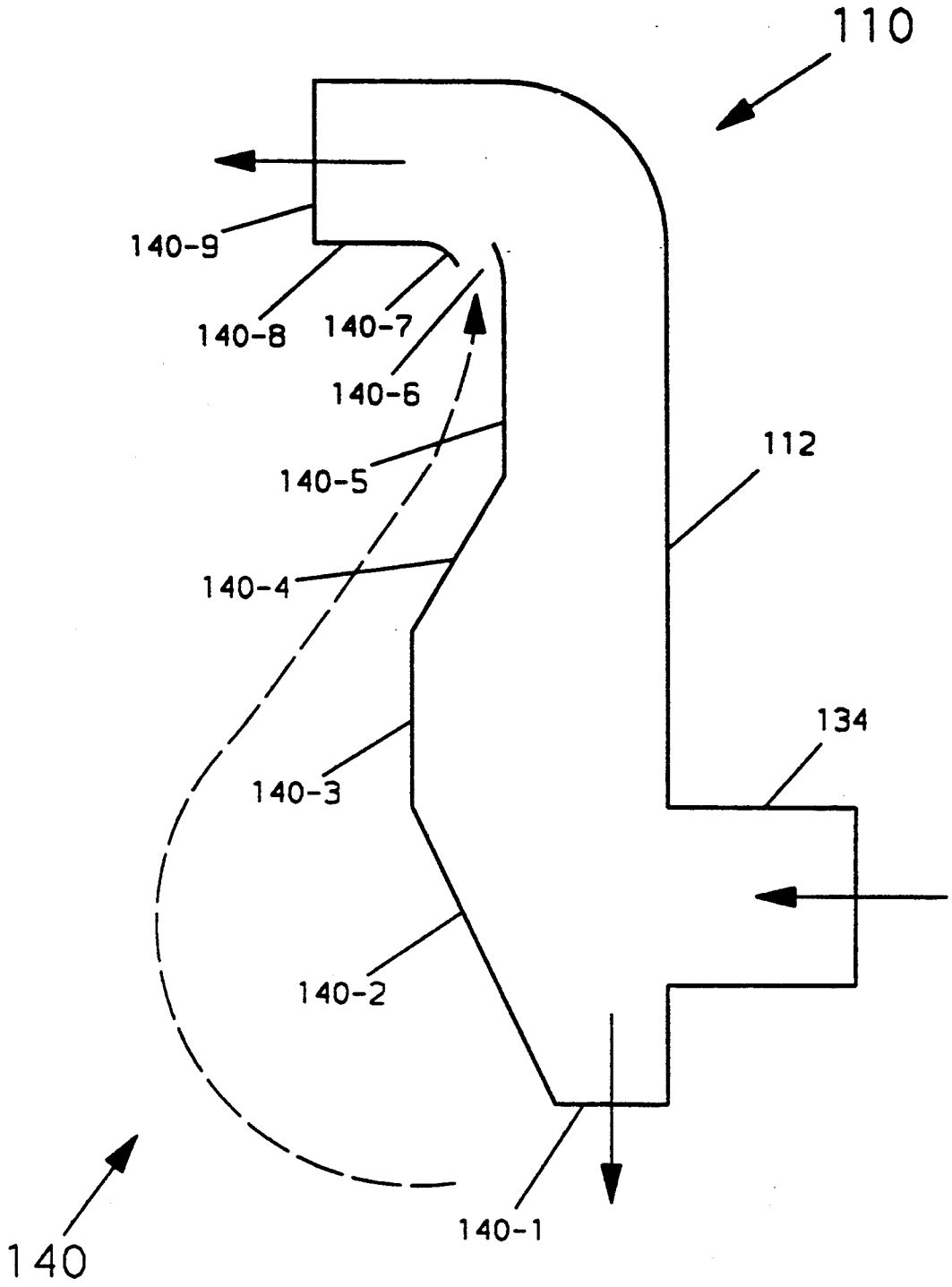
FIG. 3 is a simplified side view of a modified suction inlet duct.

Referring now to FIG. 3, suction inlet duct 140 differs from suction inlet duct 40 in three respects. First, the structure corresponding to retainer 42 and duct 44 has been made into a single piece. Second, aspiration inlet 140-6 which corresponds to aspiration inlet 46 has been relocated to the inner curve of curved portion 140-7. Third structure corresponding to aspiration inlet 48 has been eliminated, but could be provided if necessary or desired. The operation of suction inlet duct 140 is very similar to that of suction inlet duct 40.

In operation, gas entering compressor 110 via suction inlet 134 impinges upon the surface 140-2 of suction inlet duct 140. Surface 140-2, relative to the axis of suction inlet 134, is diverging in an upward direction and converging in a downward direction. The partial vacuum at the scrolls and the diverging upward path towards the scrolls favors the flow of gas upwardly to the scrolls via the closed path defined by suction inlet duct 140 and a portion of shell 112. Impingement, however, tends to produce an omnidirectional, but unevenly distributed flow. Thus, a small amount of the flow, e.g. 15%, will be diverted downwardly to outlet 140-1 and will flow into its interior of shell 112 and over the motor. The major portion of the flow moves upwardly serially through the diverging area corresponding to portion 140-2, a constant area corresponding to portion 140-3, a converging area corresponding to portion 140-4, a constant area corresponding to portion 140-5, a curved portion 140-7 containing aspiration inlet 140-6 which returns the diverted flow from the interior of the shell, and a constant area corresponding to portion 140-8. Portions 140-5 and 140-8 are of the same nominal cross sectional area and portion 140-8 discharges, via outlet 140-9 directly into the scrolls.

Although preferred embodiments of the present invention have been illustrated and described in terms of a vertical scroll compressor, other changes will occur to those skilled in the art. For example, the amount of cooling flow, how it is directed and its path may be changed due to design requirements. Also, the present invention is adaptable to other low-side hermetic compressors. It is therefore intended that the present invention is to be limited only by the scope of the appended claims.

What is claimed is:

1. A low side hermetic compressor means comprising:

shell means;

running gear within said shell means and having an inlet;

motor means for driving said running gear;

a suction inlet extending through said shell means and having an axis;

suction inlet duct means within said shell means and including a portion facing said suction inlet so as to be impinged upon by gas entering said shell means via said suction inlet;

said portion facing said suction inlet being skewed with respect to said axis of said suction inlet whereby gas entering said shell means via said suction inlet and impinging upon said portion facing said suction inlet is divided into a minor converging flow path which is directed into the interior of said shell means for cooling said motor means and a major initially diverging flow path;

said major flow path subsequently serially including a converging portion, a first fixed area portion, a curved portion, and a second fixed area portion leading to said inlet of said running gear; and aspiration means in said major flow path between said converging portion and said second fixed area for aspirating gas from said minor flow path into said major flow path for combining therewith.

2. The compressor means of claim 1 wherein said aspiration means is located in said curved portion of said major flow path.

3. The compressor means of claim 1 wherein said aspiration means is located in an outer portion of said curved portion of said major flow path.

4. The compressor means of claim 1 wherein said aspiration means is located near both an inner and an outer portion of said curved portion of said major flow path.

5. The compressor means of claim 1 wherein said first and second fixed area portions have essentially identical cross sectional areas.

6. The compressor means of claim 1 wherein said major flow path carries at least 75% of gas passing through said suction inlet.

7. The compressor means of claim 1 wherein said suction inlet means is made of two parts with a first one of said two parts having a third fixed area portion received within said first fixed area portion which is in a second one of said two parts with a clearance therebetween which defines said aspiration means.

8. The compressor means of claim 7 wherein said aspiration means is additionally located in a outer portion of said curved portion of said major flow path.

9. The compressor means of claim 1 wherein said major flow path is a confined fluid path.

* * * * *